US008317662B2

(12) United States Patent
Siipola

(10) Patent No.: US 8,317,662 B2
(45) Date of Patent: Nov. 27, 2012

(54) GRIP TRAINER

(75) Inventor: Jeffrey Michael Siipola, Sparta, NJ (US)

(73) Assignee: MaxXcel Sports LLC, Sparta, NJ (US)

( * ) Notice: Subject to any disclaimer, the term of this patent is extended or adjusted under 35 U.S.C. 154(b) by 0 days.

(21) Appl. No.: 12/651,731

(22) Filed: Jan. 4, 2010

(65) Prior Publication Data

US 2010/0173751 A1 Jul. 8, 2010

Related U.S. Application Data

(60) Provisional application No. 61/142,457, filed on Jan. 5, 2009.

(51) Int. Cl.
*A63B 23/16* (2006.01)

(52) U.S. Cl. ..... 482/49; 482/50; 482/106

(58) Field of Classification Search ..... 482/49, 482/50, 106, 108, 139; 473/298, 300, 302, 473/303, 422, 549, 568; 2/16, 17, 21, 162, 2/163, 170; 602/20–23
See application file for complete search history.

(56) References Cited

U.S. PATENT DOCUMENTS

| | | | | |
|---|---|---|---|---|
| 3,674,267 | A | 7/1972 | Hollis | |
| 3,762,720 | A | 10/1973 | Jett | |
| 3,806,130 | A | 4/1974 | Jacques | |
| 3,939,511 | A * | 2/1976 | Buttenschon | 441/118 |
| 4,195,837 | A | 4/1980 | Poulin | |
| 4,213,609 | A | 7/1980 | Swanson | |
| 4,338,270 | A | 7/1982 | Uffindell | |
| 4,361,326 | A | 11/1982 | Kokes | |
| 4,681,315 | A * | 7/1987 | Yang | 482/50 |
| 4,751,749 | A | 6/1988 | Cowhey | |
| 4,828,261 | A | 5/1989 | Kleylein | |
| 4,953,862 | A | 9/1990 | Uke | |
| 4,977,621 | A * | 12/1990 | Richard | 2/161.3 |
| 5,029,577 | A * | 7/1991 | Sarkozi | 602/18 |
| 5,055,340 | A | 10/1991 | Matsumura et al. | |
| 5,088,121 | A * | 2/1992 | Wallace | 2/160 |
| 5,116,057 | A | 5/1992 | Mangiaracina | |
| 5,160,139 | A | 11/1992 | Soong | |
| 5,211,623 | A * | 5/1993 | Sarkozi | 602/18 |
| 5,226,456 | A * | 7/1993 | Semak | 138/107 |
| 5,295,268 | A * | 3/1994 | Pociask | 2/17 |
| 5,299,802 | A | 4/1994 | Bouchet-Lassale | |
| 5,335,919 | A | 8/1994 | Soong | |

(Continued)

FOREIGN PATENT DOCUMENTS

GB 2057894 4/1981

(Continued)

OTHER PUBLICATIONS

International Search Report, mailed Mar. 15, 2010, completed by US ISA.

(Continued)

*Primary Examiner* — Glenn Richman
(74) *Attorney, Agent, or Firm* — Joseph E. Maenner; Maenner & Associates, LLC

(57) ABSTRACT

A grip trainer includes a first chamber designed to engage a stick and a second chamber attached to the first chamber. The second chamber is configured to hold an insert. An insert disposed in the second chamber. The insert has a hardness no greater than 60 on the Shore 00 Durometer scale.

11 Claims, 8 Drawing Sheets

U.S. PATENT DOCUMENTS 5,427,376 A 6/1995 Cummings et al.
5,435,549 A 7/1995 Chen
5,465,967 A 11/1995 Boeckenhaupt
5,485,996 A 1/1996 Niksich
5,524,885 A 6/1996 Heo
5,556,092 A 9/1996 Theken
5,611,533 A 3/1997 Williams
5,618,263 A * 4/1997 Alivizatos ..... 602/6
5,634,859 A 6/1997 Nesbitt
5,647,806 A * 7/1997 McDevitt ..... 473/252
5,664,607 A * 9/1997 van Wassenhove ..... 138/107
5,730,662 A 3/1998 Rens
5,769,414 A 6/1998 Feche
5,842,930 A 12/1998 Koterba
5,881,388 A * 3/1999 Pratt ..... 2/163
5,954,591 A 9/1999 Liberatore
5,984,795 A 11/1999 Stafford
5,997,421 A 12/1999 Huang
6,226,795 B1 * 5/2001 Winningham ..... 2/20
6,226,836 B1 5/2001 Yasui
6,299,557 B1 * 10/2001 Mueller ..... 473/553
6,361,450 B1 3/2002 Huang
6,431,495 B1 * 8/2002 Lawyer ..... 244/149
6,447,190 B1 9/2002 Kwitek
6,485,229 B1 * 11/2002 Gunderson et al. ..... 405/63
6,511,386 B1 1/2003 Cacicedo
6,695,713 B2 2/2004 Huang
6,725,505 B2 4/2004 Willat
6,881,164 B2 4/2005 Gilligan et al.
6,923,727 B1 8/2005 Jacobs
6,991,554 B2 1/2006 Ryan
7,022,025 B1 4/2006 Cascerceri et al.
7,081,072 B2 * 7/2006 Allen ..... 482/106
7,118,492 B2 10/2006 Hung
7,140,973 B2 11/2006 Rohrer
7,195,566 B2 3/2007 Chang
7,232,378 B2 6/2007 Jaw
7,264,759 B2 9/2007 Lamkin
7,344,447 B2 3/2008 Chang
7,377,859 B2 5/2008 Reardon
7,404,770 B2 7/2008 Huang
7,537,532 B2 * 5/2009 Young ..... 473/568
7,662,073 B1 * 2/2010 Baldwin ..... 482/92
2002/0107088 A1 8/2002 Lamkin et al.
2002/0115496 A1 8/2002 Day et al.
2002/0142856 A1 10/2002 Lindsey
2003/0096660 A1 5/2003 Ward et al.
2003/0139223 A1 7/2003 Ulrich et al.
2003/0211900 A1 11/2003 Novak et al.
2003/0216192 A1 * 11/2003 Chu ..... 473/300
2004/0062918 A1 4/2004 Johansson
2004/0248664 A1 12/2004 Billings
2004/0266546 A1 12/2004 Huang
2005/0197219 A1 9/2005 Casasanta
2006/0009304 A1 * 1/2006 Tremulis et al. ..... 473/300
2006/0194657 A1 8/2006 Aaron
2006/0205526 A1 9/2006 Whitehead et al.
2006/0252571 A1 11/2006 Wang
2006/0287123 A1 12/2006 Wang
2007/0021232 A1 1/2007 Cooper
2007/0287551 A1 12/2007 Wang et al.
2008/0039226 A1 2/2008 Chi
2008/0102974 A1 5/2008 Nam et al.
2008/0172839 A1 7/2008 Wang
2009/0275448 A1 * 11/2009 Fishman ..... 482/139
2009/0313737 A1 * 12/2009 Richard ..... 2/20

FOREIGN PATENT DOCUMENTS

WO 03047703 6/2003

OTHER PUBLICATIONS

International Preliminary Report on Patentability for PCT application No. PCT/US2010/020028, , mailed Jul. 5, 2011.

* cited by examiner

GRIP TRAINER

CROSS-REFERENCE TO RELATED APPLICATION

This application claims the benefit of U.S. Provisional Application No. 61/142,457, filed Jan. 5, 2009, which is incorporated herein in its entirety by reference.

FIELD OF THE INVENTION

This invention relates to grip training devices.

BACKGROUND OF THE INVENTION

Many sports require the player to use a handheld racket or stick as a requirement for playing the particular sport. These "stick sports" include baseball, tennis, racquetball, lacrosse, golf, hockey, and dozens of others. While playing a stick sport, the player is required to forcibly grip the end of the "stick" with one or both hands.

It is well known that the strength of a player's grip, i.e., the gripping force exerted by the player to forcibly hold the stick, dramatically influences the player's ability to control both stick motion and the amount of force the player can transmit to the stick. A strong grip usually improves the player's competitiveness by improving both the control and force of the stick motion.

Accordingly, there is a need for a device that enhances a player's gripping strength.

SUMMARY OF THE INVENTION

The present invention is a grip trainer comprising a first chamber designed to engage a stick and a second chamber attached to the first chamber. The second chamber is designed to hold an insert having compressive qualities. An insert is disposed in the second chamber.

The present invention further provides a grip trainer comprising an elongate stick passage adapted to engage a stick. The elongate stick passage has a stick passage axis extending therethrough. An elongate insert has an insert axis. The elongate insert is coupled to the elongate stick passage such that the insert axis is generally parallel to the stick passage axis. The insert has a hardness no greater than 60 on the Shore 00 Durometer scale.

The present invention also provides a grip trainer comprising a first passage adapted to engage a stick and a second passage coupled to and extending parallel to the first passage. The second passage comprises a compressive material throughout at least a portion thereof. The compressive material has a hardness no greater than 60 on the Shore 00 Durometer scale.

BRIEF DESCRIPTION OF THE DRAWINGS

The foregoing summary, as well as the following detailed description of the invention, will be better understood when read in conjunction with the appended drawings, wherein like numerals denote like elements. For the purpose of illustrating the invention, there is shown in the drawings certain embodiments of the present invention. It should be understood, however, that the invention is not limited to the precise arrangements and instrumentalities shown. In the drawings.

DETAILED DESCRIPTION OF THE INVENTION

Figure 1:
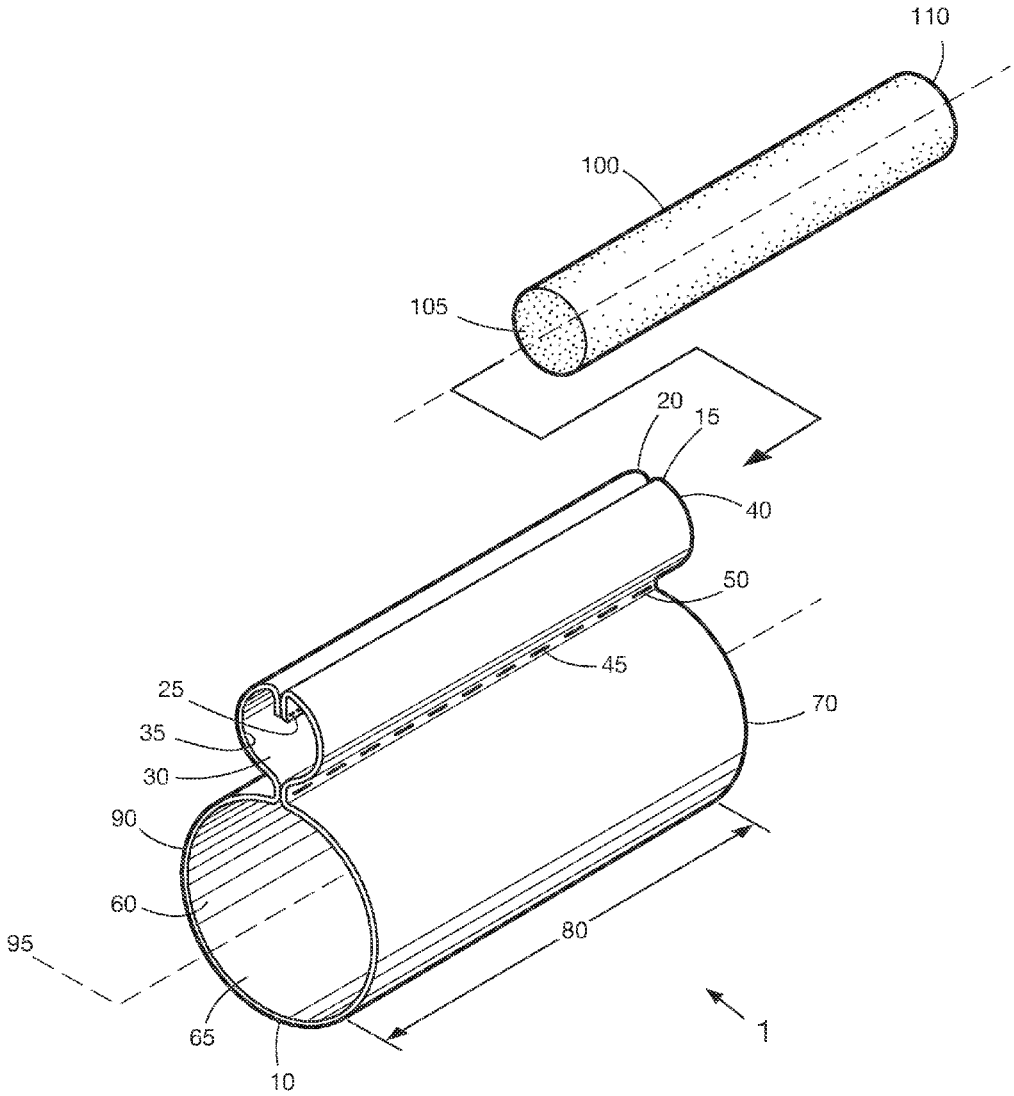
FIG. 1 is a perspective view of a first exemplary embodiment of a grip trainer in accordance with the present invention, showing the insertion direction for a pad insert.

The ensuing detailed description provides preferred exemplary embodiments only, and is not intended to limit the scope, applicability, or configuration of the invention. Rather, the ensuing detailed description of the preferred exemplary embodiments will provide those skilled in the art with an enabling description for implementing the preferred exemplary embodiments of the invention. It is understood that various changes may be made in the function and arrangement of elements without departing from the spirit and scope of the invention, as set forth in the appended claims.

To aid in describing the invention, directional terms are used in the specification and claims to describe portions of the present invention (e.g., upper, lower, left, right, etc.). These directional definitions are merely intended to assist in describing and claiming the invention and are not intended to limit the invention in any way. In addition, reference numerals that are introduced in the specification in association with a drawing figure may be repeated in one or more subsequent figures without additional description in the specification in order to provide context for other features.

As used herein, the terms "stick" includes, but is not limited to a stick, bar, baton, cane, club, crank, handle, handgrip, hilt, pole, shaft, staff, stem, rod, or other apparatus generally approximating in shape those that may be engaged by the human hand.

Referring to the embodiment of FIG. 1, grip trainer 1 is comprised of a piece of fabric 10. Fabric 10 is folded in half to create overlapping ends 15, 20. The ends 15, 20 are folded over and sewn together with stitches 27 to form a first stitched seam 25. A second stitched seam 45 downwardly displaced from, and parallel to, first stitched seam 25 is formed by stitches 50. Thus, fabric 10, having seams 25 and 45, comprises form 90, which is stretchable. Form 90 is comprised of an upper chamber 30 having ends 35 and 40, which are open, and lower chamber 60 having ends 65 and 70, which are also open. Length 80 of form 90 is preferably slightly longer than the width of a typical hand (e.g. at least 10 cm long). It should be understood, however, that form 90 may be shortened by cutting at either end to accommodate smaller grip widths. Form 90 has a longitudinal axis 95 that extends generally through a center of form 90 along its length.

Preferably, fabric 10 is highly resilient, dimensionally stable, and exhibits good elastic properties. Fabric 10 may be, for example, 600D Nylon. Alternatively, fabric 10 may be a blend of cotton fabric with a block copolymer of polyurethane and polyethylene glycol, such as commonly referred to as Spandex® brand fabric. It should be understood that any number of other suitable fabrics could be used.

In addition to form 90, grip trainer 1 further comprises a pad insert 100, which in this embodiment is substantially cylindrical-shaped. Pad insert 100 has oppositely disposed ends 105, 110. Pad insert 100 preferably comprises a cut-able, compressible, and deformable material, such as soft rubber or foam. The present invention may be used to provide an adjustable grip training device. Thus, pad insert 100 could be composed of any number of different materials having the desired compression modulus. An exemplary material is Closed Cell Sponge Cord SCE-41 SOFT, which has a density of between about 4 and about 8 pounds per cubic foot (between about 64.07 and about 128.15 kilograms per cubic meter), a tensile strength of about 75 pounds per square inch (about 517.106 KPa), and a hardness of between about 30 and about 50 on the Shore 00 Durometer scale. An alternative exemplary material is Cell Sponge Cord SCE-42 SOFT-MED, which has a density of between about 4 and about 8 pounds per cubic foot (between about 64.07 and about 128.15 kilograms per cubic meter), a tensile strength of about 100 pounds per square inch (about 689.475 KPa), and between about 45 and about 60 on the Shore 00 Durometer scale. In addition, the pad insert 100 could be of any number of cross-sectional shapes and thicknesses, including a pad insert 100 that are not uniform in shape, thickness, or compression modulus along its length. The pad insert 100 includes a longitudinal axis 105 that extends generally through a center of pad insert 100 along its length. The longitudinal axis 105 of the pad insert 100 extends parallel to the longitudinal axis 95 of the form 90.

Preferably, the length of pad insert 100 is slightly less than length 80 of form 90. This insures that as pad insert 100 is inserted and centrally located within upper chamber 30, the ends 35, 40 of the upper chamber 30 collapse around the ends 105, 110 of the pad insert, thereby maintaining the position of the pad insert 100 with respect to the form 90. In order to effectuate a tight fit within upper chamber 30, the diameter of pad insert 100 is preferably larger than that of the upper chamber 30 when it is in an unstretched state.

Figure 2:
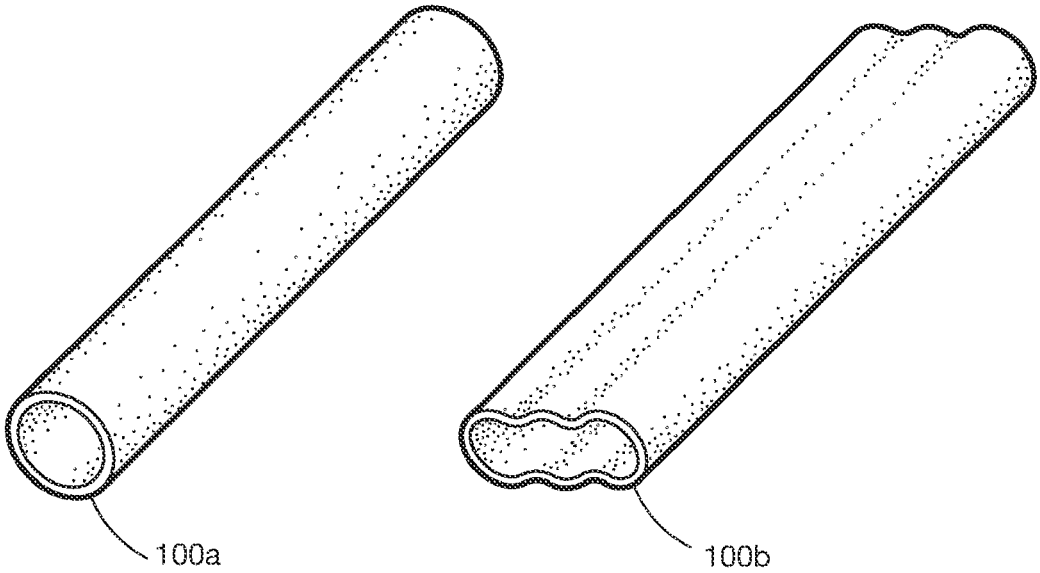
FIG. 2 is a perspective view of two embodiments of a pad insert.

Referring now to FIG. 2, pad insert 100*a* is composed of foam and pad insert 100*b* is composed of rubber, which has a greater compression modulus than pad insert 100*a*. Different compression moduli and cross sectional shapes associated with the pad insert 100 permit a range of gripping force exercises. For example, a pad insert 100 having a compression modulus equal to 20 would require less gripping force than would a pad insert 100 having a compression modulus of 40, in order to be compressed equally. As will be seen, it is also within the scope of the invention that the pad insert 100 could have varying compression moduli across its length, thereby allowing for targeted training of specific finger, hand, and arm muscles.

To use the grip trainer 1, the user first selects a pad insert 100 according to the specific grip arrangement that the user wishes to train. For example, the user may wish to exercise the index, middle, and ring fingers of a particular hand. The user would then insert a pad insert 100, having the desired configuration of compression moduli necessary to train the targeted grip arrangement, into the upper chamber 30.

In one embodiment, this could be accomplished by inserting a pad insert 100 having varied compression moduli along its length. For example, the user could insert a pad insert 100 having a higher compression modulus corresponding with the index, middle, and ring finger positions than the compression modulus that corresponds with the position of the pinkie finger. It should be understood, however, that any arrangement of compression moduli along the length of the pad insert 100 could be used to train a desired grip arrangement, including a pad insert 100 having three or four different compression moduli along its length, or a pad insert 100 having higher compression moduli corresponding with non-adjacent finger positions.

In a separate embodiment, variation in compression moduli could be accomplished by providing more than one pad insert having different compression moduli, which are cut to a desired length and separately inserted into the upper chamber 30. For example, if the user desired to train the ring and pinkie fingers, a pad insert (not shown) having the desired compression modulus could be cut to the appropriate length and inserted into upper chamber 30 in a position corresponding with the ring and pinkie finger positions. A pad insert (not shown), having a lower compression modulus, could then be cut to the appropriate length and inserted into the upper chamber 30 in a position corresponding with the index and middle finger positions. In the alternative, the pad insert corresponding with the index and middle finger positions could be omitted entirely. It should be understood that any number of pad inserts could be inserted into the upper chamber 30 to establish the desired grip arrangement.

As the pad insert 100 is inserted into the upper chamber 30, the elastic quality of the fabric 10 and the ends 35, 40 of the upper chamber 30 hold the pad insert 100 in its proper position along the length of the upper chamber 30. The elastic quality of the fabric 10 accommodates deformation of the pad insert 100 caused by the gripping force exerted by the user to the pad insert 100, and further acts to maintain the proper positioning of the pad insert 100 within the upper chamber 30. It should be understood that the elastic quality of the fabric 10 would act in a similar fashion if multiple pad inserts were inserted within the upper chamber 30.

Figure 3:
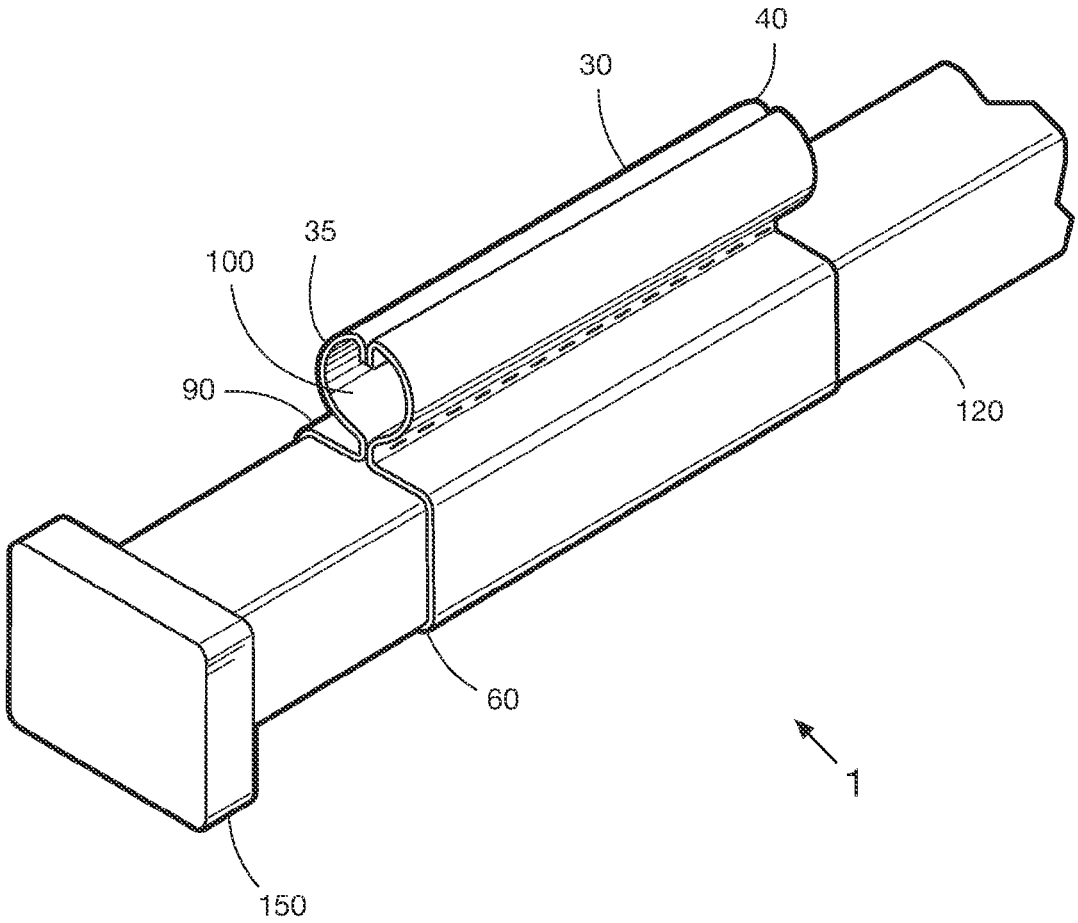
FIG. 3 is a perspective view of an exemplary embodiment of a grip trainer installed around a stick.

FIG. 3 shows a first embodiment of the grip trainer 1 installed around the end of a stick 120. In order to install the grip trainer 1 around the stick 120, the user first extends the end of the stick 120 through the lower chamber 60 of the form 90. The elasticity of the fabric 10 allows for the stretching of the lower chamber 60 and its ends 65, 70 over any lip 150 or other obstruction that may be located at the end of the stick 120. The elastic quality also allows the grip trainer 1 to be quickly and easily moved from one stick to another. Sticks having different cross-sectional shapes, including for example round, oblong, or square, are easily accommodated by the stretching of fabric 10.

When fabric 10 is stretched, the resulting elastic force holds the form 90 around the stick 120 in the desired position. A stick 120 that requires two hands for operation would preferably require a form 90 that is elongated to correspond with the appropriate width of the user's two-handed grip. In the alternative, two separate grip trainers could be installed on the stick 120. This configuration may be preferable for stick sports that require two-hand use, such as, for example baseball, hockey, and lacrosse.

Figure 4:
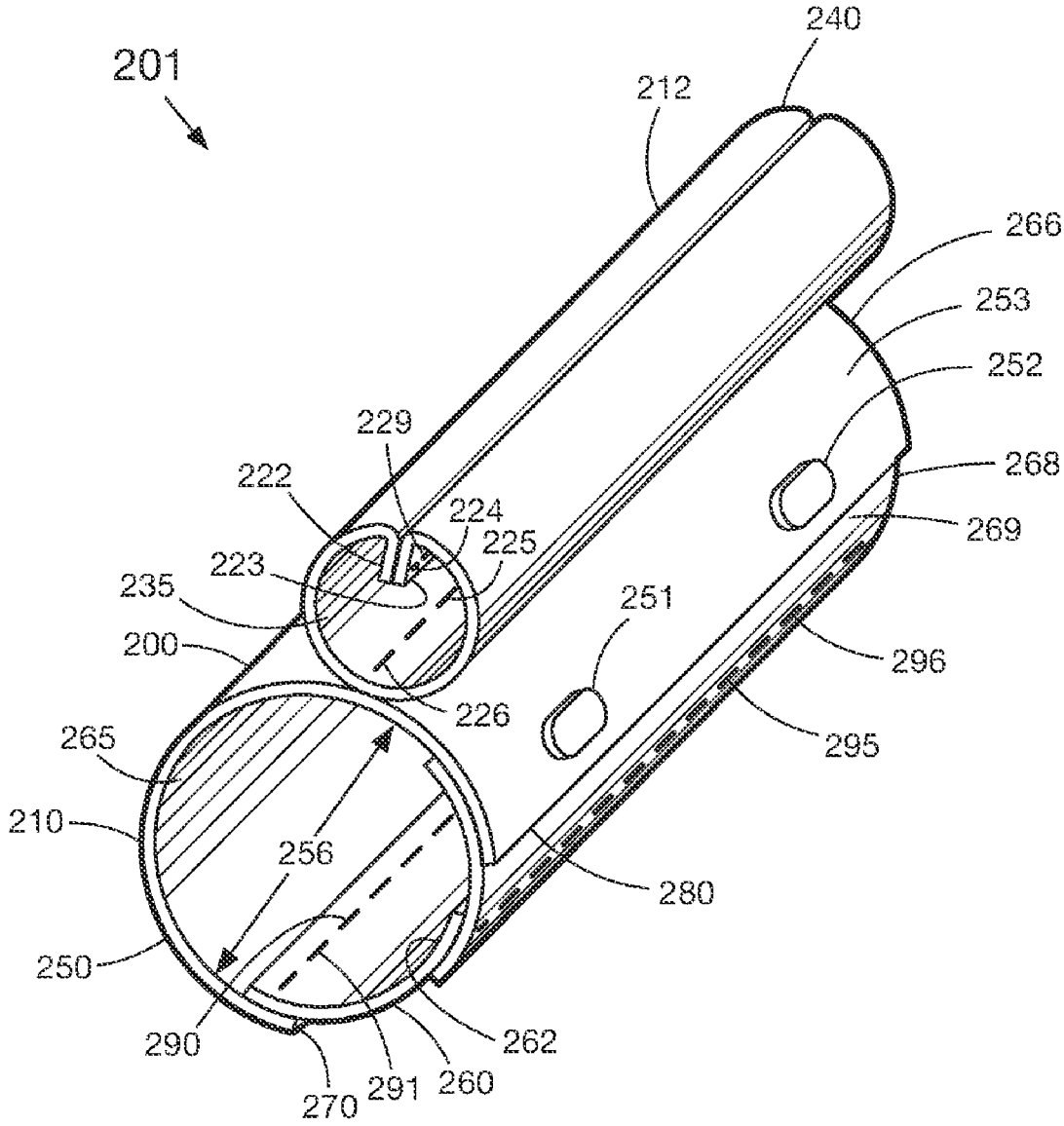
FIG. 4 is a perspective view of an exemplary embodiment of a grip trainer in accordance with the present invention.

An alternate embodiment of the invention is shown in FIG. 4. Grip trainer 201 is comprised of a form 200, having a lower chamber 210 and an upper chamber 220. Lower chamber 210 has open ends 265, 266 and is substantially cylindrical in shape. Upper chamber 220 has ends 235, 240, which are open, and is also substantially cylindrical in shape. Upper chamber 220 is formed by folding and stitching together the ends 222, 223 of the fabric 212 to form a first stitched seam 229 comprised of stitches 224. Upper chamber 220 is attached to the upper external surface of lower chamber 210 by a second stitched seam 226 comprised of stitches 225.

Figure 5:
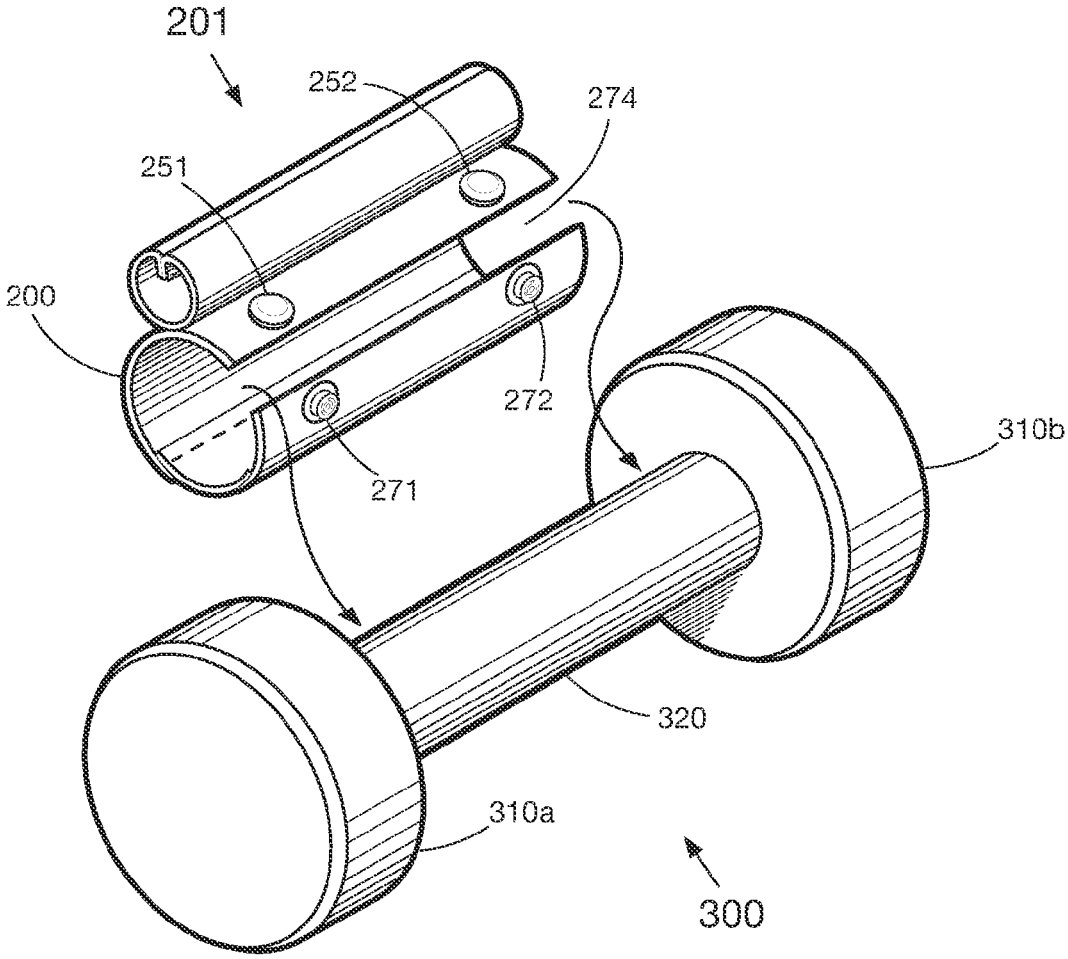
FIG. 5 is a perspective view of an exemplary embodiment of a grip trainer, showing the installation direction around a dumbbell.

In this embodiment, lower chamber 210 is constructed partially from a piece 250 having female snap buttons 251, 252 attached to its external surface 253. Piece 250 is flexible and may be compressed to decrease its diameter 256 or spread apart to increase its diameter 256. Piece 250 is connected along an end 270 to elastic band 260 by a third stitched seam 291 which is comprised of stitches 290. The end 262 of elastic band 260 which opposed the third stitched seam 291 is attached to a piece 268 by a fourth stitched seam 295, which is comprised of stitches 296. Piece 268 is of curved shape, approximating a partial cylinder. The external surface 269 of piece 268 has male stakes 271 and 272 (see FIG. 5) that correspond with and are capable of engaging female snap buttons 251 and 252, respectively. Thus, a user can join pieces 250, 268 forcibly together by joining the male stakes 271, 272 to the female snap buttons 251, 252. Pieces 250 and 268 may be constructed from conventional vinyl or any other suitable material that is soft and formable. It should be understood that the diameter 256 of the lower chamber 210 when it is closed should be smaller than the diameter of the stick that will be inserted into the lower chamber 210, in order to create a gripping force on the stick when the grip trainer 201 is fully installed.

This embodiment has the advantage of being easily installable around items having very large ends. For example, referring now to FIG. 5, a dumbbell 300 having a handle 320 and end weights 310*a*, 310*b* is shown. To install the grip trainer 201 around the dumbbell 300, the user would first open the lower chamber 210 by releasing the female snap buttons 251, 252 from the male stakes 271, 272, creating a gap 274. Gap 274 is spread open to the extent necessary to slide the handle 320 through the gap 274 and into the lower chamber 210. Lower chamber 210 is thus placed around the handle 320 without the need to forcibly pull the lower chamber 210 over any lip, knob, or other obstruction that may be present at the end of the stick.

Once positioned around handle 320, pieces 250 and 268 are joined together by forcibly joining the male stakes 271, 272 to the female snap buttons 251, 252. Joining of the pieces 250, 268 requires that the elastic band 260 be stretched to accommodate the diameter of the handle 320, which is larger than the diameter 256 of the lower chamber 210 when the lower chamber 210 is closed, yet unengaged from a stick. The user then selects the desired pad insert or inserts (not shown)—as discussed above with respect to the first embodiment—according to the desired grip arrangement, and installs the pad insert into the upper chamber 220.

Figure 6:
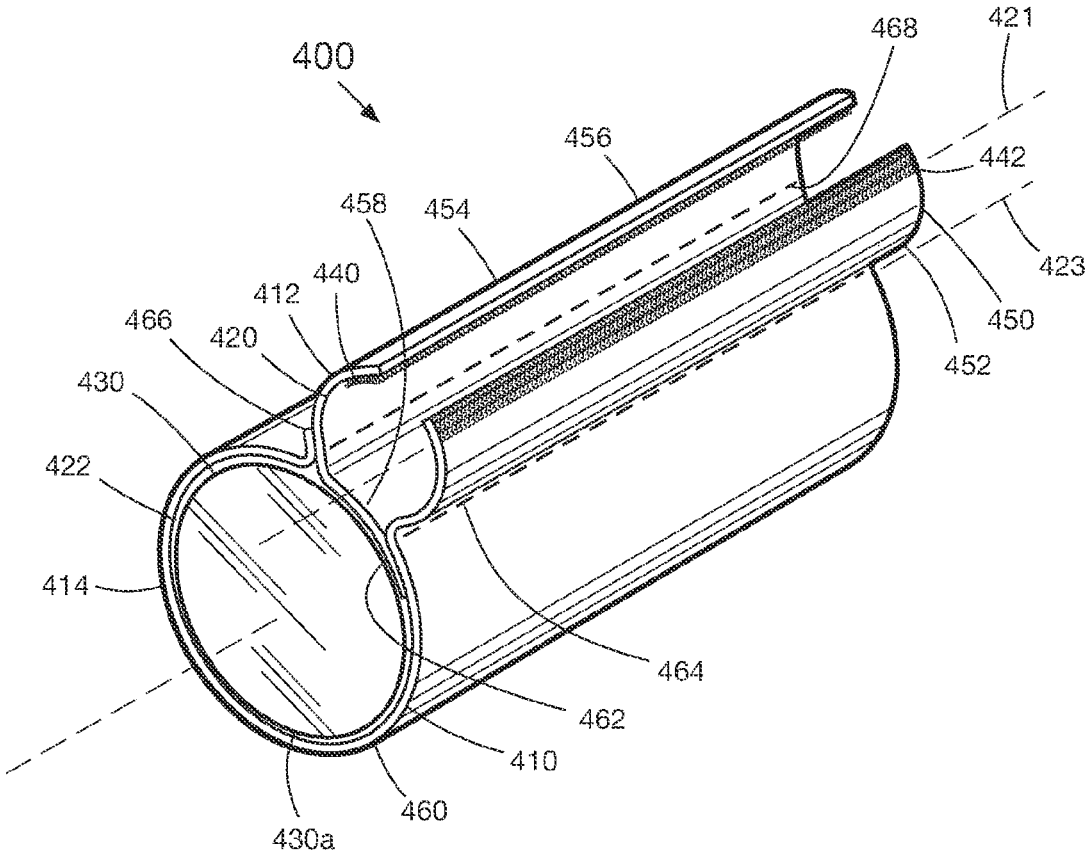
FIG. 6 is a perspective view of an exemplary embodiment of a grip trainer in accordance with the present invention.

In an alternative embodiment of the present invention, illustrated in FIG. 6, a grip trainer 400 includes a fabric 410 that forms a first elongate portion 412 and a second elongate portion 414 attached to first elongate portion 412. First elongate portion 412 forms a first chamber, or passage, 420 having a first axis 421 and second elongate portion 414 forms a second chamber, or passage, 422 having a second axis 423, parallel to first axis 421. First passage 420 is sized to engage a stick (not shown) and second passage 422 is sized to receive an insert 430 formed from a compressive material that extends throughout at least a portion of second passage 422.

Figure 7:
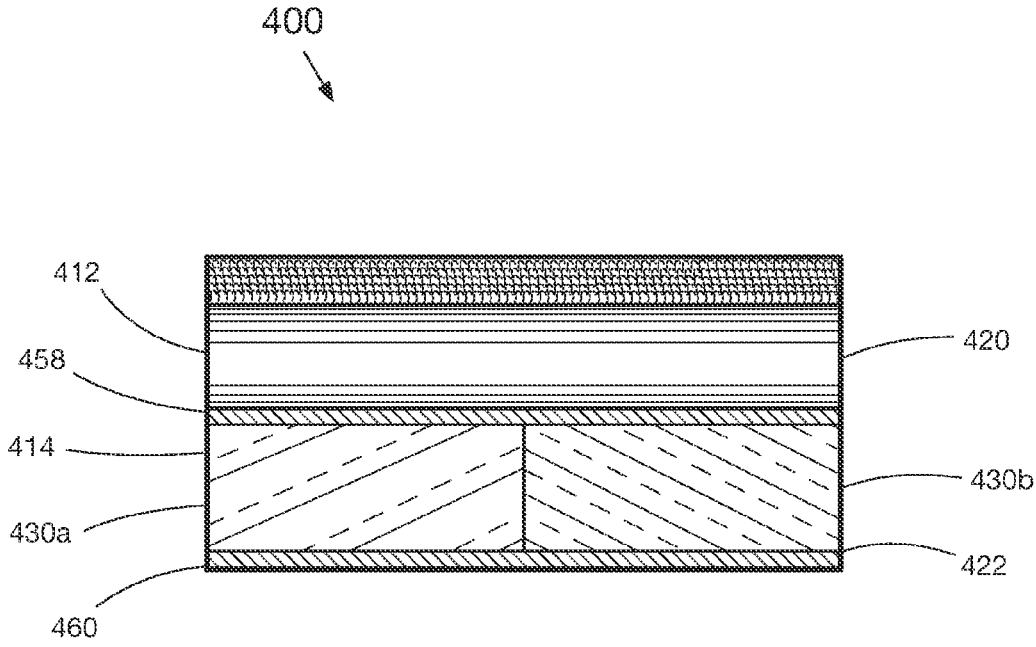
FIG. 7 is a cross-sectional view of the grip trainer of FIG. 6.

Referring to the longitudinal cross-sectional view of grip trainer 400 illustrated in FIG. 7, insert 430 may different or varying compression moduli along its length. As shown in FIG. 7, this may be accomplished by using a plurality of inserts 430*a*, 430*b* having different compression moduli. The varying compression moduli may strengthen different fingers at different rates.

Figure 8:
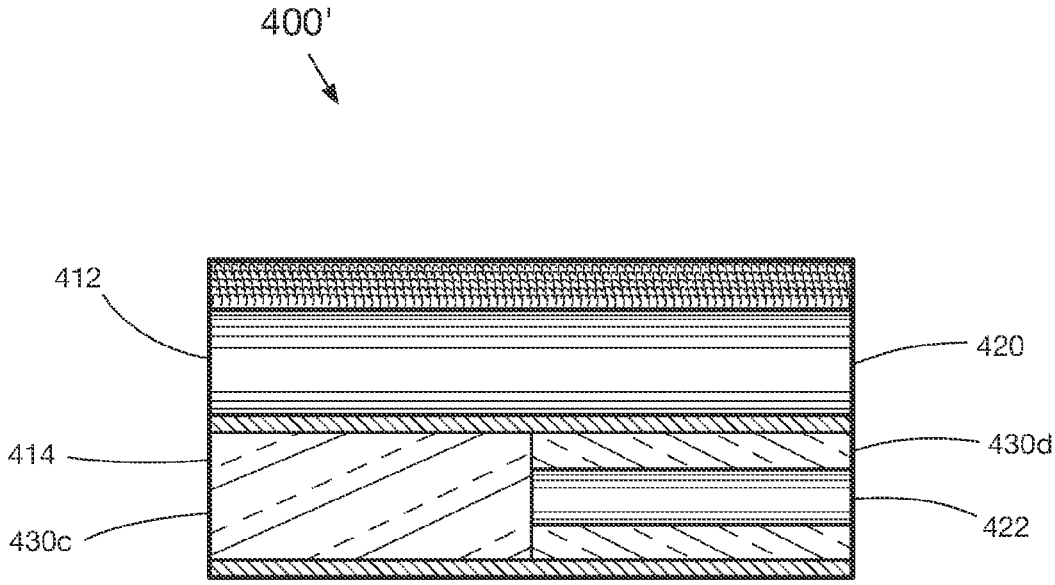
FIG. 8 is a cross-sectional view of an alternative embodiment of the grip trainer of FIG. 6.

Alternatively, as illustrated in an alternative embodiment of a grip trainer 400' in FIG. 8, inserts 430*c*, 430*d* may have different cross-sections. While the embodiment illustrated in FIG. 8 illustrates insert 430*c* having a circular cross-section and insert 430*d* has an annular cross-section, those skilled in the art will recognize that other cross-sections may be used.

Referring back to FIG. 7, first passage 420 comprises a first free end 440 and a second free end 442 that is releasably couplable to first free end 440. First free end 440 may include one of a hook and loop connector and second free end 442 may include the other of the hook and loop connector. An exemplary hook and loop connector may be a VELCRO® connector.

First passage 420 comprises an initial portion 450 of a first fabric piece 452 and an initial portion 454 of a second fabric piece 456. Second passage 422 comprises a remaining portion 458 of first fabric piece 452 and a remaining portion 460 of second fabric piece 456. Remaining portion 458 of first fabric piece 452 further comprises part of first passage 420. As shown in FIG. 6, an end 462 of first fabric piece 452 is sewn to second fabric piece 456 along a seam 464 that extends the length of grip trainer 400. Further, an end 466 of second fabric piece 456 is sewn to first fabric piece 452 along a seam 468 that extends the length of grip trainer 400.

As described above, the invention has many applications and should not be assumed to be useful only in sporting applications. For example, the invention can be used as an exercise device to assist in the rehabilitation of injured hands, fingers, and lower arm muscles by providing for a gradual increase in the required gripping force necessary to hold a weighted object.

While the principles of the invention have been described above in connection with preferred embodiments, it is to be clearly understood that this description is made only by way of example and not as a limitation of the scope of the invention.

The invention claimed is:

1. A grip trainer for use with a stick, the grip trainer comprising:

a first piece of fabric having a first inner surface and a first outer surface, the first inner surface having a first part of a releasable coupling; and a second piece of fabric having a second inner surface and a second outer surface, the second outer surface having a second part of the releasable coupling such that the first part of the releasable coupling is releasably joinable with the second part of the releasable coupling such that at least part of the first inner surface forms a first chamber, wherein the first piece of fabric and the second piece of fabric are joined at a first seam and a second seam such that at least part of the second inner surface forms a second chamber; and a compressible material insert contained within the second chamber.

2. The grip trainer according to claim 1, wherein the insert comprises a plurality of inserts having varying compression moduli.

3. The grip trainer according to claim 1, wherein the compressible material insert has a plurality of compression moduli along its length.

4. The grip trainer according to claim 3, wherein a first compression modulus is associated with a first length of the compressible material insert and wherein a second compression modulus is associated with a second length of the compressible material insert.

5. The grip trainer according to claim 1, wherein the insert is removably contained within the first fabric material and the second fabric material.

6. The grip trainer according to claim 1, wherein the second seam extends parallel to the first seam.

7. The grip trainer according to claim 1, wherein the first chamber is generally cylindrical.

8. The grip trainer according to claim 1, wherein, when the first part of the releasable coupling is releasably joined with the second part of the releasable coupling, the grip trainer comprises a first chamber and a second chamber.

9. A grip trainer for use with a stick, the grip trainer comprising:

a body constructed from two pieces of fabric material, the body including:

a first fabric material having a first connecting portion;

a second fabric material having a second connecting portion releasably connectable to the first connecting portion such that at least a first portion of the first fabric material forms a first chamber, wherein the first fabric material and the second fabric material are sewn together along a first seam and a second seam, parallel to the first seam, such that a second portion of the first fabric material between the first seam and the second seam and a portion of the second fabric material form a second chamber; and a compressible insert being inserted into the second chamber.

10. The grip trainer according to claim 9, wherein the first chamber has a diameter and wherein the length of the first chamber is greater than the diameter.

11. The grip trainer according to claim 9, wherein the chamber includes an open end.

* * * * *